US007677533B2

(12) United States Patent
Fracasso et al.

(10) Patent No.: US 7,677,533 B2
(45) Date of Patent: Mar. 16, 2010

(54) GUARDRAIL

(75) Inventors: Alvise Fracasso, Stra (IT); Moreno Quaggio, Brvgine (IT)

(73) Assignee: Metalmeccanica Fracasso S.p.A., Via Barbariga (IT)

( * ) Notice: Subject to any disclaimer, the term of this patent is extended or adjusted under 35 U.S.C. 154(b) by 227 days.

(21) Appl. No.: 11/888,894

(22) Filed: Aug. 1, 2007

(65) Prior Publication Data

US 2008/0054240 A1 Mar. 6, 2008

(30) Foreign Application Priority Data

Aug. 2, 2006 (IT) ..... TV2006A0140

(51) Int. Cl.
*E01F 15/04* (2006.01)

(52) U.S. Cl. ..... 256/13.1; 256/65.01; 404/6; 404/9

(58) Field of Classification Search ..... 256/1, 256/11, 13.1, 19; 404/6–9
See application file for complete search history.

(56) References Cited

U.S. PATENT DOCUMENTS 2,030,782 A * 2/1936 Dennebaum ..... 256/13.1
2,085,098 A * 6/1937 Height et al. ..... 256/13.1
2,168,930 A * 8/1939 Bradshaw ..... 256/13.1
2,171,948 A * 9/1939 Patton ..... 256/13.1
3,643,924 A * 2/1972 Fitch ..... 256/13.1
RE29,544 E * 2/1978 Fitch ..... 256/13.1
4,101,115 A * 7/1978 Meinzer ..... 256/13.1
2004/0079931 A1 4/2004 Climente

FOREIGN PATENT DOCUMENTS

EP 343091 11/1989
WO WO 98/42918 10/1998

OTHER PUBLICATIONS

EU Search Report, EP07113713, Oct. 8, 2007.

* cited by examiner

*Primary Examiner*—Daniel P Stodola
*Assistant Examiner*—Ernesto Garcia
(74) *Attorney, Agent, or Firm*—Jeffrey J. King

(57) ABSTRACT

A guardrail defined by a number of vertical supporting posts fixed successively to the ground along the edge of a road, and by one or more longitudinal members fixed successively and substantially horizontally to the vertical posts to form a longitudinal transverse retaining member extending along the edge of the road, at a predetermined height off the ground; each of the longitudinal members being defined by a rigid, controlled-deformation strip of composite material, which is bent back on itself to form a substantially S-shaped first longitudinal portion and a substantially C-shaped second longitudinal portion adjoining and covering the first longitudinal portion, so as to form a tubular, complex-section body extending from one vertical post to another and substantially parallel to and a predetermined height off the ground.

15 Claims, 3 Drawing Sheets

GUARDRAIL

RELATED APPLICATION

This is a Utility application which claims priority under all applicable laws, including 35 USC § 119 and the Paris Convention, to Italian application number TV2006A000140, filed Aug. 2, 2006, which is incorporated herein in its entirety by reference.

RELATED APPLICATIONS

This is a Continuation application which claims priority to Italian application number TV2006A000140, filed Aug. 2, 2006 and is incorporated herein by reference.

FIELD OF THE INVENTION

The present invention relates to a guardrail. More specifically, the present invention relates to a guardrail designed to effectively attenuate impact by a motorcyclist or cyclist; to which application the following description refers purely by way of example.

BACKGROUND OF THE INVENTION

As is known, the most commonly used guardrails are made of metal, and comprise a number of vertical supporting posts fixed successively into the ground along the edge of a road; and a number of longitudinal retaining members fixed horizontally and successively to the supporting posts to form a longitudinal retainer extending seamlessly along the edge of the road, at a given height off the ground.

Unfortunately, guardrails of the above type are carefully designed to stop and retain motor vehicles of normally over a ton in weight, while subjecting the occupants to deceleration below a regulation maximum limit, and so constitute potentially hazardous obstacles in the event of motorcyclists or cyclists falling and forcefully striking the supporting posts of the guardrail.

In fact, after falling, motorcyclists or cyclists invariably continue sliding along the tarmac until they hit one of the posts of the guardrail along the edge of the road, and most undergo serious injuries, which can be mortal even at relatively low impact speed, when the guardrail supporting posts have "sharp" edges.

SUMMARY OF THE INVENTION

It is an object of the present invention to provide a guardrail designed to appropriately and gradually attenuate impact by a motorcyclist or cyclist, and so reduce the degree of impact-induced injury.

According to the present invention, there is provided a guardrail as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE DRAWINGS

Figures 1, 1A:
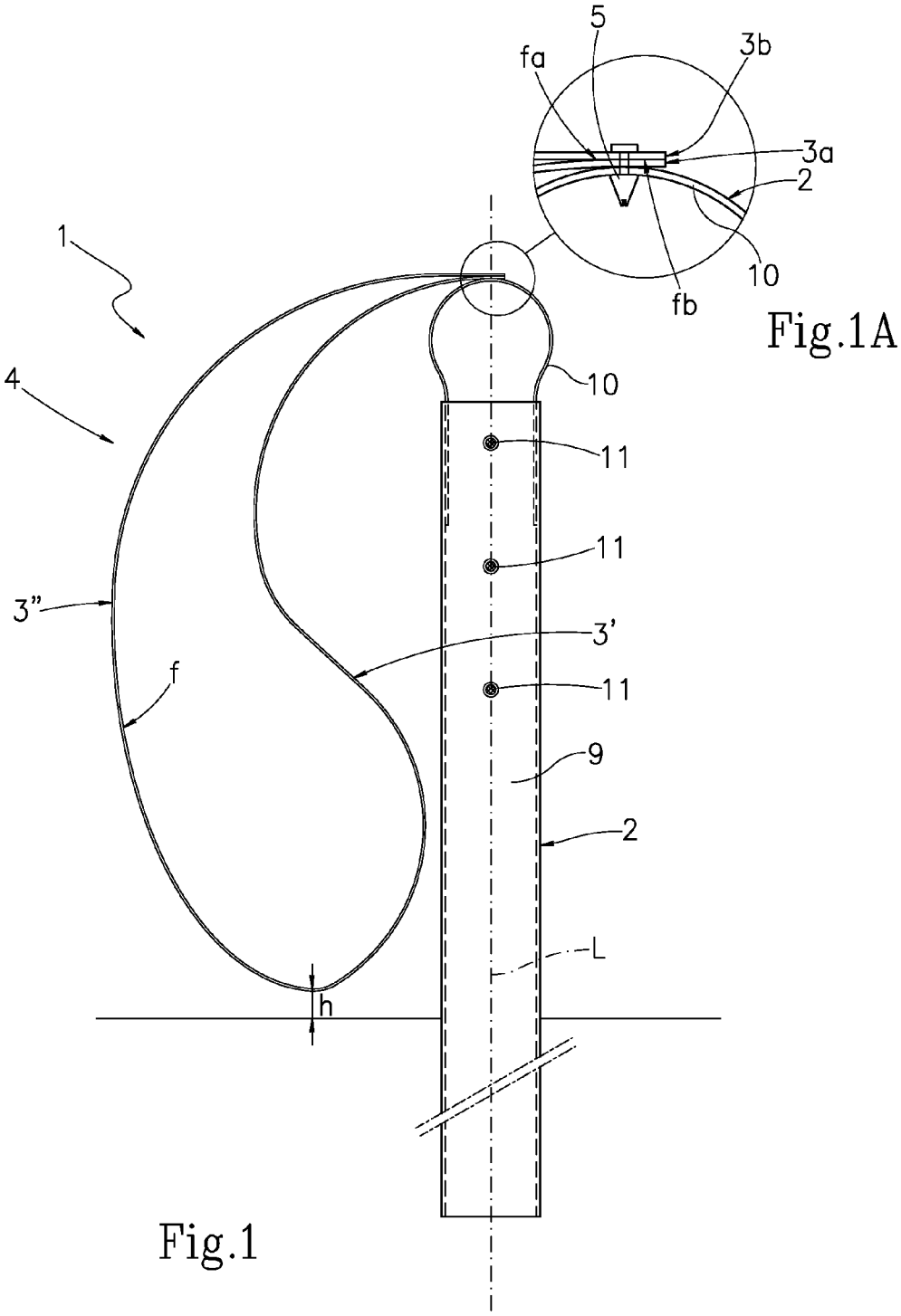
FIG. 1 shows a side view, with parts in section and parts removed for clarity, of a guardrail in accordance with the teachings of the present invention.
FIG. 1A shows a blown up view of the fixed retaining member
Figure 2:
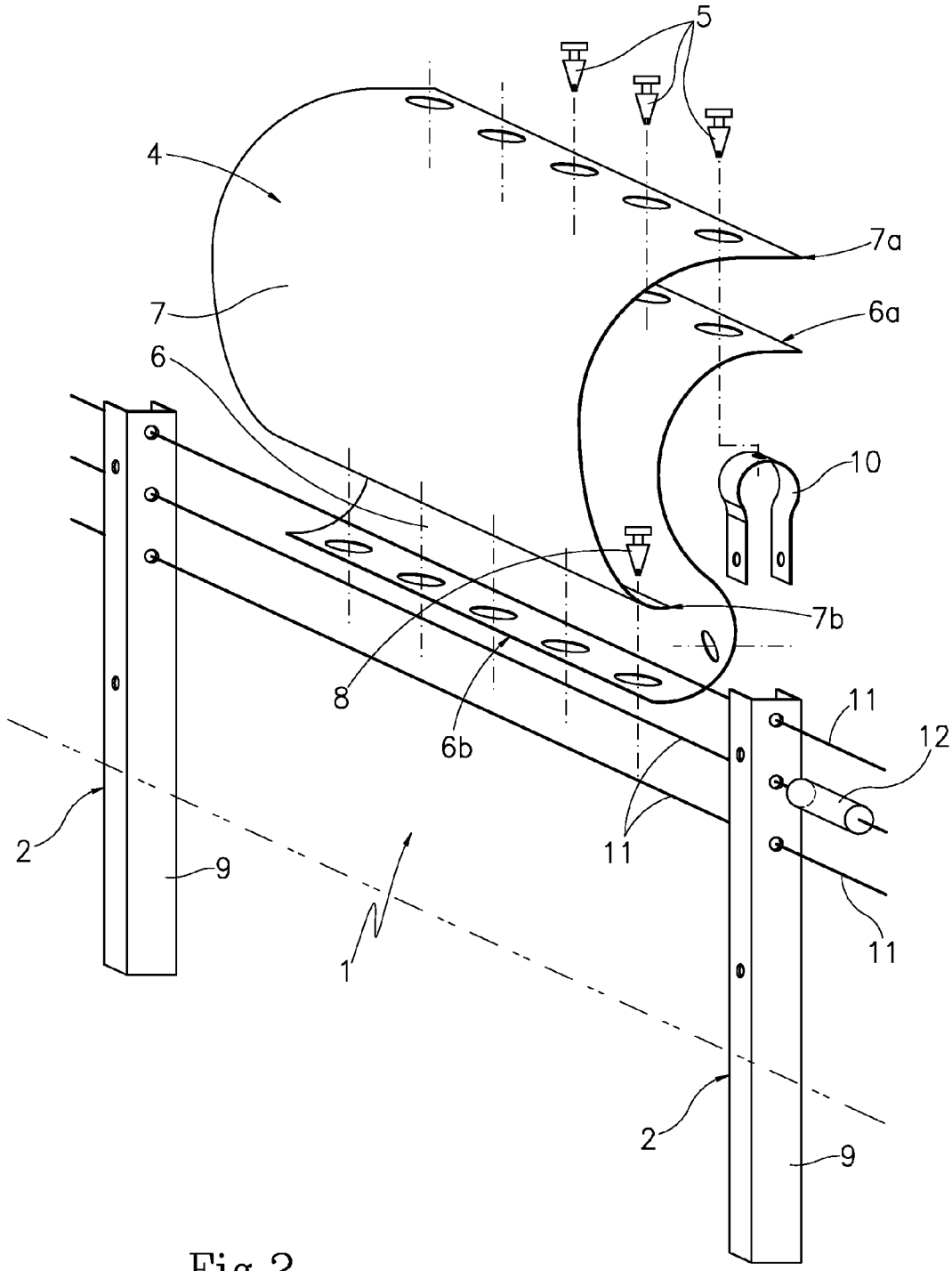
FIG. 2 shows an exploded three-dimensional view of the FIG. 1 guardrail.

Number 1 in FIGS. 1 and 2 indicates as a whole a guardrail installed along the edge of a road to gradually absorb the kinetic energy of a car or similar vehicle striking the guardrail, while at the same time redirecting the vehicle towards the centre of the road, and which is also designed to gradually attenuate in controlled manner impact by a cyclist, motorcyclist, or similar sliding along the road surface and striking the guardrail.

Guardrail 1 substantially comprises a number of vertical supporting posts 2 (only one shown in the drawings) fixed successively into the ground along the edge of the road; and one or more longitudinal members of appropriate length, which are fixed successively and substantially horizontally to vertical posts 2 to form a longitudinal transverse retaining member 4 extending seamlessly along the edge of the road, at a given height off the ground.

Unlike known guardrails, at least one of longitudinal members (all, in the example shown) comprises a rigid, controlled-deformation strip of composite material, which is bent back on itself, so that the two opposite lateral portions or margins $f_a$ and $f_b$ of the same face f of strip rest one on top of the other to form a complex-section tubular body, which is fixed to at least two consecutive vertical posts 2 of the guardrail, and is substantially parallel to and a given height off the ground.

More specifically, strip of composite material is fixed to vertical posts 2 of the guardrail by the longitudinal rib formed by the two superimposed opposite lateral portions $f_a$ and $f_b$ of face f of strip, so that the tubular body formed by strip projects from the vertical plane of vertical posts 2 out into the road alongside, and extends towards the ground, i.e. downwards, along the side of vertical posts 2, so that the central section of strip is a minimum height h of preferably, though not necessary, 1-10 centimetres off the ground.

In other words, strip of composite material is bent back on itself to form two contiguous longitudinal portions 3' and 3", the first of which is bounded laterally by a lateral edge 3*a* of strip, directly faces vertical posts 2 of the guardrail, and is substantially S-shaped, so that lateral edge 3*a* of strip is located close to the top of vertical posts 2 of the guardrail, and the boundary line with longitudinal portion 3" is located below lateral edge 3*a* of strip, at a minimum height h of preferably, though not necessarily, 1-10 centimetres off the ground.

Longitudinal portion 3", on the other hand, is bounded laterally by the second lateral edge 3*b* of strip, directly faces the road, and is substantially C-shaped to cover longitudinal portion 3', and so that second lateral edge 3*b* of strip rests on first lateral edge 3*a* to form a tubular body with a substantially pear-shaped cross section.

In the example shown, the two lateral edges 3*a*, 3*b* of strip are fixed one on top of the other by a number of through rivets 5 made of hard rubber or other elastically deformable material and appropriately spaced along said edges, and are fixed firmly to the top ends of two consecutive vertical posts 2 of the guardrail by some of through rivets 5, so as to cover the top of vertical posts 2.

With reference to FIG. 2, in the example shown, strip of composite material substantially comprises two controlled-deformation half-shells 6 and 7 of composite material, which are fixed rigidly to each other at the lateral edges, preferably, though not necessarily, by a second number of through rivets 8 of hard rubber or other elastically deformable material.

More specifically, half-shell 6 is defined by a straight section 6 of composite material with a substantially S-shaped cross section, which extends parallel to the ground and is fixed to vertical posts 2 of the guardrail so that a first lateral edge 6*a* rests on the top ends of vertical posts 2, and a second lateral edge 6*b* extends parallel to the ground, below lateral edge 6*a*, and at a height off the ground substantially equal to the minimum height h of strip off the ground.

Half-shell 7, on the other hand, is defined by a straight section 7 of composite material with a substantially C-shaped cross section, which extends parallel to the ground and is fixed to vertical posts 2 of the guardrail, on top of section 6, so that a first lateral edge 7*a* rests on lateral edge 6*a* of section 6 and therefore on the ends of vertical posts 2 underneath, and a second lateral edge 7*b* rests on lateral edge 6*b* of section 6.

As regards through rivets 8, in the example shown, each section 6, 7 has a number of through holes appropriately spaced along lateral edges 6*a* and 6*b*, 7*a* and 7*b* of the section, and which are superimposed on the through holes in lateral edges 7*a* and 7*b*, 6*a* and 6*b* of the other section when sections 6 and 7 are superimposed. Lateral edges 6*a* and 7*a* of sections 6 and 7 correspond to lateral edges 3*a* and 3*b* of strip, and are therefore connected firmly to each other by through rivets 5, which are forced inside the holes along lateral edges 6*a* and 7*a*; and through rivets 8 are forced inside the holes along lateral edges 6*b* and 7*b* of sections 6 and 7 to secure lateral edge 7*b* of section 7 on lateral edge 6*b* of section 6.

In addition, as stated, some of through rivets 5 securing lateral edge 7*a* of section 7 on lateral edge 6*a* of section 6 also serve to firmly secure sections 6 and 7 of strip 3 directly to the top ends of vertical posts 2 of the guardrail.

With reference to FIGS. 1 and 2, in the example shown, each vertical supporting post 2 substantially comprises a rigid bar 9 of composite material with a preferably, though not necessarily, U-shaped cross section, which is fixed partly and substantially vertically into the ground; and an elastic connecting bracket 10 fixed to the top end of bar 9 and interposed between bar 9 and the longitudinal rib formed by the two superimposed lateral edges 3*a*, 3*b* of strip, i.e. the rib formed by superimposing lateral edge 7*a* of section 7 and lateral edge 6*a* of section 6.

In the example shown, elastic connecting bracket 10 is defined by a controlled-deformation, elongated rectangular strap of composite material, which is bent substantially into an inverted U with an arc-shaped central portion, and is fixed rigidly at both ends to bar 9 to form an elastic member on which strip 3, i.e. longitudinal retaining member 4 of the guardrail, rests directly and is fixed firmly.

More specifically, in the example shown in FIGS. 1 and 2, the arc-shaped central portion of elastic bracket 10 has a through slot or hole preferably, though not necessarily, aligned with the longitudinal axis L of bar 9, and in which is forced one of the through rivets 5 holding the two opposite lateral portions $f_a$ and $f_b$ of face f of strip, i.e. lateral edge 7*a* of section 7 and lateral edge 6*a* of section 6, firmly one on top of the other.

With reference to FIGS. 1 and 2, guardrail 1 preferably, though not necessarily, also comprises a number of retaining lines 11, which extend, parallel to the ground and spaced apart vertically, alongside longitudinal members forming longitudinal transverse retaining member 4, slide inside through holes formed in vertical posts 2 or, rather, vertical bars 9 of the guardrail, and are secured firmly to the ground at the ends in known manner.

Guardrail 1 also comprises a number of tensioning devices 12 arranged along retaining lines 11 and designed to adjust, and if necessary also maintain, the tension of the retaining lines 11 to which the tensioning devices 12 are fitted.

In the example shown, each retaining line 11 comprises a number of twisted strands of composite material and appropriate cross section.

As regards the materials used, the two half-shells 6, 7 of strip 3 are preferably, though not necessarily, made of one or more superimposed layers of appropriately interwoven glass fibres and/or carbon fibres and/or aramidic fibres embedded in a preferably, though not necessarily, self-extinguishing epoxy resin matrix. Similarly, bars 9 and elastic brackets 10 forming vertical posts 2 are preferably, though not necessarily, made of one or more superimposed layers of appropriately interwoven glass fibres and/or carbon fibres and/or aramidic fibres embedded in a preferably, though not necessarily, self-extinguishing epoxy resin matrix.

Retaining lines 11 preferably, though not necessarily, comprise a bundle of twisted strands of nylon and/or carbon or similar synthetic materials.

Guardrail 1 functions in exactly the same way as known guardrails, and therefore requires no explanation, except to point out that the particular design of longitudinal members, combined with the materials from which they are made, provides for gradually absorbing impact of a motorcyclist or cyclist against longitudinal transverse retaining member 4 of the guardrail, regardless of whether the rider slides along the tarmac onto longitudinal transverse retaining member 4, or is thrown off the vehicle and falls full weight onto longitudinal transverse retaining member 4.

In the first case, longitudinal member gradually deforms elastoplastically at the point of impact to absorb the kinetic energy of the rider and so maintain acceptable deceleration of the rider. In the second case, longitudinal member flexes at the point of impact, and elastic brackets 10 of composite material on top of vertical posts 2 gradually deform, so that the combined effect of the two elastoplastic deformations maintains acceptable deceleration of the rider striking the guardrail.

In addition, by virtue of the shape of longitudinal members, a rider sliding along the road surface onto guardrail 1 is prevented from sliding through the guardrail beneath longitudinal transverse retaining member 4. That is, the minimum height h of the bottom edge of longitudinal member off the ground prevents anyone in an outstretched position from sliding beneath the longitudinal member.

By virtue of retaining lines 11, guardrail 1, 1' is obviously also still capable of gradually absorbing the kinetic energy of a car striking the guardrail, and so stopping and/or redirecting the car towards the centre of the road, while subjecting the occupants to the regulation degree of deceleration.

The advantages of guardrail 1, 1' are obvious: by virtue of its design and the particular materials used, guardrail 1, 1' is capable of completely stopping and/or redirecting a car colliding with it towards the centre of the road, while subjecting the occupants to the regulation degree of deceleration, and also of appropriately and gradually attenuating impact by a motorcyclist or cyclist, to reduce the degree of impact-induced injury.

Clearly, changes may be made to guardrail 1, 1' as described and illustrated herein without, however, departing from the scope of the present invention.

Figure 3:
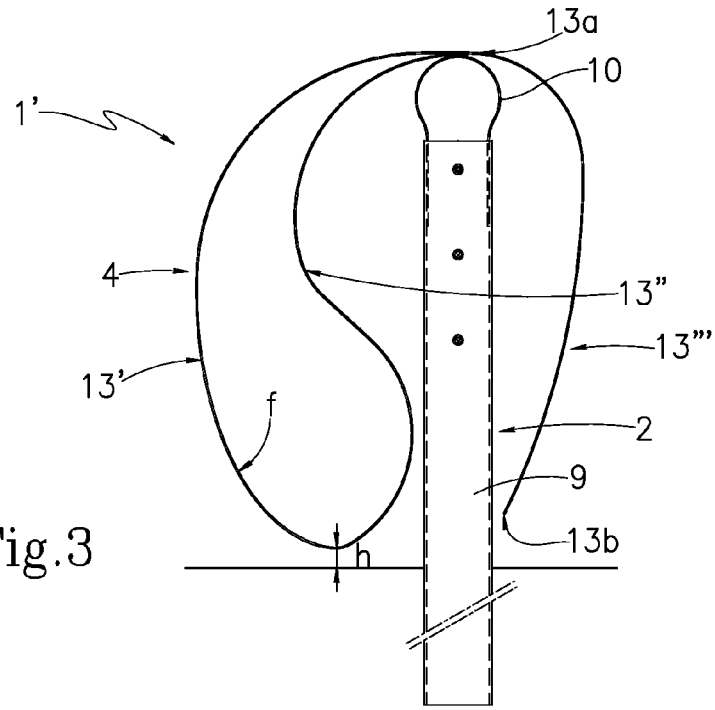
FIGS. 3 and 4 show, respectively, a side view with parts in section and parts removed for clarity, and an exploded three-dimensional view of a variation of the FIGS. 1 and 2 guardrail.
Figure 4:
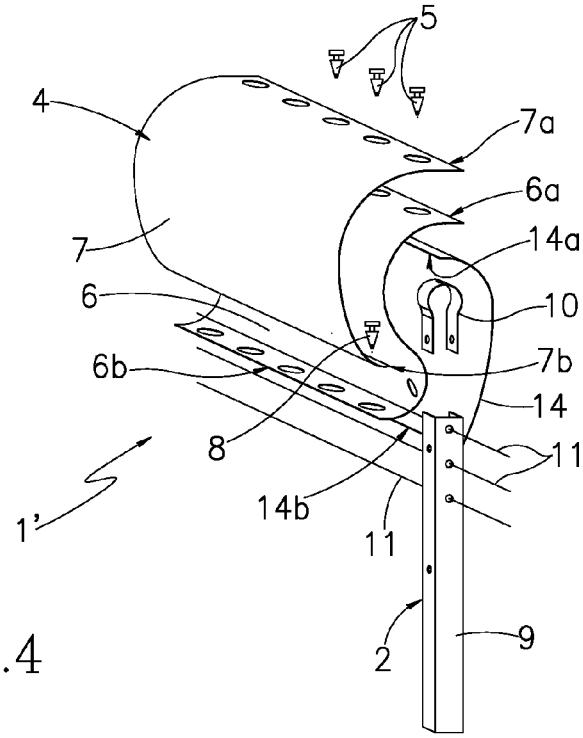

More specifically, in the FIGS. 3 and 4 variation, each horizontal longitudinal member forming longitudinal transverse retaining member 4 of the guardrail comprises a controlled-deformation strip of composite material, which is bent substantially into an inverted U, and a longitudinal portion of strip is bent back on itself so that one of the two lateral edges 13*a* of strip rests on the mid-section of the concave face of strip to form a complex-section tubular body inwards of the concave face.

In this case, strip of composite material is positioned astride two consecutive vertical posts 2 of the guardrail, with the lateral edge 13*a* of strip and the mid-section of the concave face of strip fixed firmly to the top of vertical posts 2 by through rivets, which secure lateral edge 13*a* of strip firmly on the mid-section of the concave face of strip, in the same way as described with reference to FIGS. 1 and 2.

More specifically, strip of composite material has a first lateral edge 13*a* fixed firmly to the top of vertical posts 2 of the guardrail, and is bent back on itself to define a central longitudinal portion 13', and two lateral longitudinal portions 13" and 13'" adjoining central longitudinal portion 13'.

Lateral longitudinal portion 13" is bounded laterally by lateral edge 13*a* of strip, directly faces vertical posts 2 of the guardrail, and is substantially S-shaped, so that lateral edge 13*a* of strip is fixed firmly to the top of vertical posts 2 of the guardrail, and the boundary line with central longitudinal portion 13' of strip is located below lateral edge 13*a* of strip, at a minimum height h of preferably, though not necessarily, 1-10 centimetres off the ground.

Central longitudinal portion 13' directly faces the road, and is substantially C-shaped to cover lateral longitudinal portion 13", and so that the second lateral edge of central longitudinal portion 13', coinciding with the boundary line with lateral longitudinal portion 13'", is located at the top of vertical posts 2 of the guardrail, substantially resting on lateral edge 13*a* of strip to form a tubular body with a substantially pear-shaped cross section.

Lateral longitudinal portion 13'" of strip is bounded laterally by the second lateral edge 13*b* of strip, and is substantially C-shaped, so that lateral edge 13*b* of strip is located on the opposite side of vertical posts 2 of the guardrail to lateral longitudinal portion 13", and is substantially aligned with the boundary line between central longitudinal portion 13' and lateral longitudinal portion 13".

In the example shown in FIG. 4, strip of composite material differs from strip in FIG. 2 by comprising—in addition to the two half-shells 6 and 7, and the two numbers of through rivets 5 and 8 described—a third controlled-deformation half-shell 14 of composite material, which is fixed firmly to half-shells 6 and 7 at the top of vertical posts 2, and projects towards the ground, i.e. downwards, from the vertical plane of vertical posts 2, on the opposite side of vertical posts 2 to half-shells 6 and 7, to cover the lateral side of vertical posts 2.

More specifically, like half-shell 7, half-shell 14 is defined by a straight section 14 of composite material with a substantially C-shaped cross section, which extends parallel to the ground, and is fixed to vertical posts 2 of the guardrail, together with sections 6 and 7, so that a first lateral edge 14*a* rests on lateral edges 6*a* and 7*a* of sections 6 and 7, at the top of vertical posts 2, and a second lateral edge 14*b* close to the ground.

Obviously, lateral edge 14*a* of section 14 is fixed firmly to lateral edges 6*a* and 7*a* of sections 6 and 7 by through rivets 5, some of which fix the whole of strip firmly to the top of vertical posts 2 of the guardrail.

We claim:

1. A guardrail (1) comprising a number of vertical supporting posts (2) fixed successively to the ground along the edge of a road; and one or more longitudinal members fixed successively and substantially horizontally to said vertical posts (2) to form a longitudinal transverse retaining member (4) extending along the edge of the road, at a predetermined height off the ground;

at least one of said longitudinal members comprises a rigid, controlled-deformation strip bent back on itself to form a tubular, complex-section body extending, substantially parallel to and at the predetermined height off the ground, from one of the vertical posts (2) to another of the vertical posts, and to define at least a first (3', 13") and a second (3", 13') longitudinal portion adjoining each other;

the first longitudinal portion (3', 13") of the strip being bounded laterally by a first lateral edge (3*a*, 13*a*) of said strip, being positioned facing the vertical posts (2) of the guardrail, and being substantially S-shaped, so that the first lateral edge (3*a*, 13*a*) of said strip is located close to the top of the vertical posts (2), and a boundary line with the second longitudinal portion (3", 13') of said strip is located below the first lateral edge (3*a*, 13*a*) of the strip (3, 13), at a predetermined minimum height (h) off the ground;

the second longitudinal portion (3", 13') of the strip being substantially C-shaped covering said first longitudinal portion (3', 13"), from the boundary line to the first lateral edge so that a second lateral edge (3*b*) of the second longitudinal portion rests on the first lateral edge (3*a*, 13*a*) of said strip.

2. A guardrail as claimed in claim 1, characterized in that the rigid strip forming said longitudinal member is fixed firmly to said vertical posts (2) at the longitudinal rib formed by superimposing the first lateral edge (3*a*, 13*a*) of the strip and the second lateral edge (3*b*) of the second longitudinal portion (3", 13') of the strip (3, 13).

3. A guardrail as claimed in claim 1, characterized by also comprising retaining lines (11) having ends secured to the ground, extending substantially parallel to the ground, alongside the longitudinal members forming said longitudinal transverse retaining member (4), and sliding inside through holes formed in the vertical posts (2) of the guardrail.

4. A guardrail as claimed in claim 3, characterized by also comprising a number of tensioning devices (12) arranged along the retaining lines (11) and designed to adjust the tension of the retaining lines (11) to which the tensioning devices are fitted.

5. A guardrail as claimed in claim 3, characterized in that said retaining lines (11) are made of synthetic material.

6. A guardrail as claimed in claim 5, characterized in that synthetic material comprises nylon or carbon.

7. A guardrail as claimed in claim 1, characterized in that at least one of said vertical posts (2) comprises a bar (9) fixed partly and substantially vertically into the ground; and an elastic connecting bracket (10) interposed between said bar (9) and said longitudinal member.

8. A guardrail as claimed in claim 7, characterized in that said elastic connecting bracket (10) is located at the top of said bar (9).

9. A guardrail as claimed in claim 1, characterized in that said rigid strip also comprises a third longitudinal portion (13'") adjoining said second longitudinal portion (13'), on the opposite side of said first longitudinal portion (13"); said third longitudinal portion (13'") being bounded laterally by a second lateral edge (13*b*) of said strip, and being substantially C-shaped, so that said second lateral edge (13*b*) of the strip is located on the opposite side of the vertical posts (2) of the guardrail to the first longitudinal portion (13") of the strip, and is substantially aligned with the boundary line between said first (13") and said second (13') longitudinal portion of the strip.

10. A guardrail as claimed in claim 1, characterized in that said rigid strip is made at least partly of composite material.

11. A guardrail as claimed in claim 8, characterized in that said composite material comprises at least one layer of appropriately interwoven fibers comprising one of glass carbon, or aramid embedded in an epoxy resin matrix.

12. A guardrail as claimed in claim 1, characterized in that said vertical posts (2) are made at least partly of composite material.

13. A guardrail as claimed in claim 1, characterized in that the boundary line between said first (3', 13") and said second (3", 13') longitudinal portion of the strip is located at a minimum height (h) of 1 to 10 centimetres off the ground.

14. A guardrail as claimed in claim 1, characterized in that the first lateral edge (3*a*, 13*a*) of said first longitudinal portion (3', 13") and the second lateral edge (3*b*) of said second longitudinal portion (3", 13') of said strip are fixed to each other by a number of through rivets (5).

15. A guardrail as claimed in claim 14, characterized in that said through rivets (5) are made of an elastically deformable material.

* * * * *